United States Patent [19]

Killian

[11] 4,408,577

[45] Oct. 11, 1983

[54] ROTARY ENGINE

[76] Inventor: Henry R. Killian, 915 Longview, Sugarland, Tex. 77478

[21] Appl. No.: 182,856

[22] Filed: Sep. 2, 1980

[51] Int. Cl.[3] ..... F02B 75/22

[52] U.S. Cl. ..... 123/55 AA; 123/44 E; 123/56 C

[58] Field of Search ..... 123/43 C, 44 E, 56 R, 123/56 A, 56 AC, 56 C, 58 R, 50 A, 80 BA, 190 A, 51 R, 51 A, 55 R, 55 A, 55 AA

[56] References Cited

U.S. PATENT DOCUMENTS

| | | | |
|---|---|---|---|
| 1,456,479 | 5/1923 | Atkinson et al. | 123/43 C |
| 1,776,843 | 9/1930 | Schafer | 123/51 AA |
| 1,853,563 | 4/1932 | Hungerford et al. | 123/44 E |
| 2,371,005 | 3/1945 | Wagers | 123/55 AA |
| 3,526,216 | 9/1970 | Henvaux | 123/80 BA |
| 3,942,488 | 3/1976 | Phillips et al. | 123/56 C |
| 4,030,471 | 6/1977 | Ginkel | 123/51 R |
| 4,244,338 | 1/1981 | Rassey | 123/190 A |

FOREIGN PATENT DOCUMENTS

| | | | |
|---|---|---|---|
| 625924 | 9/1961 | Italy | 123/44 E |
| 559830 | 3/1944 | United Kingdom | 123/190 A |
| 1224163 | 3/1971 | United Kingdom | 124/44 E |

*Primary Examiner*—Craig R. Feinberg
*Attorney, Agent, or Firm*—Browning, Bushman, Zamecki& Anderson

[57] ABSTRACT

Disclosed are apparatus for a two cylinder rotary internal combustion engine comprising a stationary cylinder block with a pair of inwardly facing horizontally opposed pistons operating within. Each piston is maintained in fixed relationship to the other by means of a common connecting rod. A cam roller assembly is included at each outer extremity of the opposed pistons for transmitting reciprocating motion to an eccentric cam raceway provided within an outer rotating frame assembly which is rotably mounted with respect to the stationary cylinder block. An output drive shaft is connected to the rotating frame. Tubular cylindrical intake and exhaust valves communicate with each cylinder, with a geneva drive mechanism provided for imparting stepwise counter-rotational motion to said valves for admitting combustible mixture and exhausting combustion gasses at proper intervals. In a preferred embodiment, a four cylinder rotary engine is illustrated comprising two pairs of horizontally opposed piston with two eccentric cam raceways arranged for mechanically balanced operation in a four cycle engine having two power strokes per revolution.

21 Claims, 17 Drawing Figures

ROTARY ENGINE

BACKGROUND OF THE INVENTION

1. Field of the Invention

The present invention relates to rotary internal combustion engines and associated valve apparatus for inducting combustible mixture and educting exhaust gasses. More specifically, the present invention relates to a rotary cam internal combustion engine wherein reciprocating motion of horizontally opposed pistons is transformed into rotary output motion. Tubular rotary valves are employed for communication of combustible mixture to the cylinder bores and for extraction of exhaust gasses at appropriate times in the operational cycle of the engine.

2. Description of Prior Art

A number of rotary type internal combustion engines have previously been proposed with numerous objectives and advantages attibutable to each. However, of paramount importance today in the face of dwindling hydrocarbon fuel resources, is the search for a more fuel efficient internal combustion engine. In addition, improved engines which reduce or minimize pollutants discharged to the environment are highly desirable.

In response to these and other considerations, several rotary engines have been divised. For example, U.S. Pat. No. 3,964,450 to Lockshaw discloses a rotary cam type internal combustion engine comprising a stationary cylinder block and a rotatable casing. Reciprocating pistons are connected to a cam slot machined into the rotatable casing by means of a connecting rod having a cam follower secured to the outer end of the rod. The main drive shaft is attached to the rotatable casing and incorporates fuel intake and exhaust passages. A portion of the main drive shaft passes through the center of the stationary block and includes intake and exhaust ports which communicate in timed sequence with a single port opening in each of a plurality of radially oriented cylinder bores. In U.S. Pat. No. 2,894,496 to Townsend, a rotary internal combustion engine comprises a stationary outer cam apparatus, a rotary cylinder block assembly, and a stationary shaft which passes through the center of the cylinder block. The stationary shaft serves as an inlet and exhaust manifold for radially oriented cylinders, as well as a journal for the rotating block. Individual pistons within each radial cylinder include a cam follower means for imparting motion to the piston as the stationary cam surface is traversed. U.S. Pat. No. 4,038,953, also issued to Townsend, discloses a similar rotating block and stationary cam engine. However, improved means for accomplishing intake and exhaust functions are disclosed.

Although a number of rotary type combustion engines have been proposed, implementation of the concepts involved have been largely unsuccessful due to various factors such as complex mechanical arrangements, and exposure of rotating elements to the high temperatures of the exhaust gasses. For example, the engine disclosed in the Lockshaw patent requires a cam slot which restrains a cam follower in two directions to provide accurate positioning of the piston throughout the operational cycle. In both the Lockshaw and Townsend patents, rotating seals for intake and exhaust gasses are required due to clearances which must be provided between rotating and stationary components. Maintaining effective sealing of hot exhaust gasses for an acceptable period of time in these designs presents a major problem. Further, in the rotating block, stationary cam disclosures, the lack of positive means for stroking a piston through the intake cycle precludes practical application of this apparatus for a normally aspirated four cycle engine.

SUMMARY OF THE INVENTION

Accordingly, there is a need for a practical and more efficient design of a rotary internal combustion engine. It is therefore a principle object of the present invention to provide such an improved rotary engine.

Another object of the present invention is to provide a rotary internal combustion engine having a simple and rugged mechanism for positive positioning of pistons throughout the operational cycle.

Yet another object of the present invention is to provide a rotary internal combustion engine having cam surfaces and cam followers which are subjected to compressive loadings only.

A further object of the present invention is to provide an improved rotary internal combustion engine having inlet and exhaust provisions which offer minimum resistance to flow and which eliminate the need for rotating seals between stationary and rotatable engine components.

Still another object of the present invention is to provide a simple and rugged rotary valve apparatus capable of withstanding peak combustion pressures and temperatures with minimum leakage.

Another object of the present invention is to provide a novel rotary valve actuation apparatus which requires minimum power drain and permits full opening of inlet and exhaust valves for a longer period of time with minimum overlap during transition between intake and exhaust strokes.

Yet another object of the present invention is to provide a novel rotary valve apparatus which is capable of serving a pair of cylinders with a single valve port opening in the cylindrical rotary valve.

The above and other objects of the present invention will become apparent from the drawings, the description provided herein, and the appended claims.

The rotary internal combustion engine of the present invention includes a stationary cylinder block having a pair of horizontally opposed cylinder bores. A pair of opposed, inwardly facing pistons are mounted at opposite ends of a common connecting rod which communicates through a central dividing wall between the two cylinder bores. A cam follower is provided within the skirt portion of each piston for contact with an eccentric cam surface located within an outer rotating frame assembly. As the interconnected pistons reciprocate within the cylinder block, combustion forces are transmitted to the eccentric cam surface imparting rotational motion to the outer rotating frame. A drive shaft is connected to the outer rotating frame providing means for transmission of power. The outer rotating frame assembly is supported for rotation about the stationary cylinder block by means of bearings located between the cylinder block and a pair of annular flanges provided on the rotating frame assembly. A cylindrical housing with circular top and bottom portions completely encloses the stationary block and rotating frame assembly.

In the illustrated embodiment of the present invention, a pair of counter-rotating tubular cylindrical valves are provided for admitting combustible mixture and exhausting the products of combustion. Cylinder inlet and exhaust ports, adjacent to the common dividing wall between the two cylinder bores in the stationary cylinder block are provided for each horizontal cylinder. Vertical valve bores for receiving the tubular cylindrical inlet and exhaust valves partially intersect each cylinder inlet and exhaust port, thus providing passageways for communicating combustible mixture to the cylinders and exhausting products of combustion therefrom. Each cylindrical valve includes an arctuate valve port opening such that, as the valve is rotated, the arctuate valve port opening may align with a cylinder port, thereby permitting entrance or exit of gasses. Openings are included in the engine housing which align with the interior portion of the tubular cylindrical valves. Combustible mixture from any conventional source such as a carburetor, may thus be communicated to the inlet valve, and exhaust gasses may be withdrawn from the engine by the usual piping means.

The tubular cylindrical inlet and exhaust valves each include a longitudinal valve shaft extension which protrudes through a valve shaft bore in the cylinder block. The valve shaft extensions engage valve actuation means which provide timed rotation of the cylindrical valves at appropriate moments in the operational cycle of the engine.

In an illustrated embodiment, valve actuation is provided by means of a geneva mechanism, the driver element of which is attached to the engine drive shaft. A geneva driven element is affixed to one valve shaft extension, which also includes a first spur gear mounted thereon. The second valve shaft extension has a second spur gear mounted thereon for engagement with said first spur gear. Through said geneva mechanism and said first and second spur gears, counter rotating cylindrical valves may be actuated in timed relationship to the degree of rotation of the drive shaft, by which the geneva drive mechanism is operated. In an alternative embodiment, the geneva drive mechanism may be replaced by a drive gear attached to the output shaft of the engine which engages a driven gear on one of the valve shaft extensions. First and second spur gears are also provided on each valve shaft extension as previously described. The pitch diameters of the drive gear and driven gear are in a ratio of 1:2 to provide the proper degree of rotation of the cylindrical valves with respect to the degree of rotation of the engine drive shaft.

In a preferred form, the present invention comprises a stationary cylinder block having two adjacent pairs of horizontally opposed cylinder bores with parallel centerlines. First and second pairs of inwardly facing horizontally opposed pistons, including cam followers, are employed in conjunction with two adjacent eccentric cam surfaces located within the outer rotating frame assembly. Cam surfaces are in angular alignment which enables construction of a four cycle internal combustion engine having a balanced two power strokes per revolution of the outer rotating frame assembly. Valving for the second pair of cylinders is provided by extending each tubular cylindrical valve a sufficient distance allowing incorporation of a second valve port opening which aligns with cylinder inlet and exhaust ports provided for the second pair of cylinders. The second valve port included in each cylindrical valve may be positioned at an appropriate angular offset with respect to the first opening to accomodate a firing order for the second pair of cylinders which is 360° out of phase with that of the first pair of cylinders.

DESCRIPTION OF PREFERRED EMBODIMENTS

Figure 1:
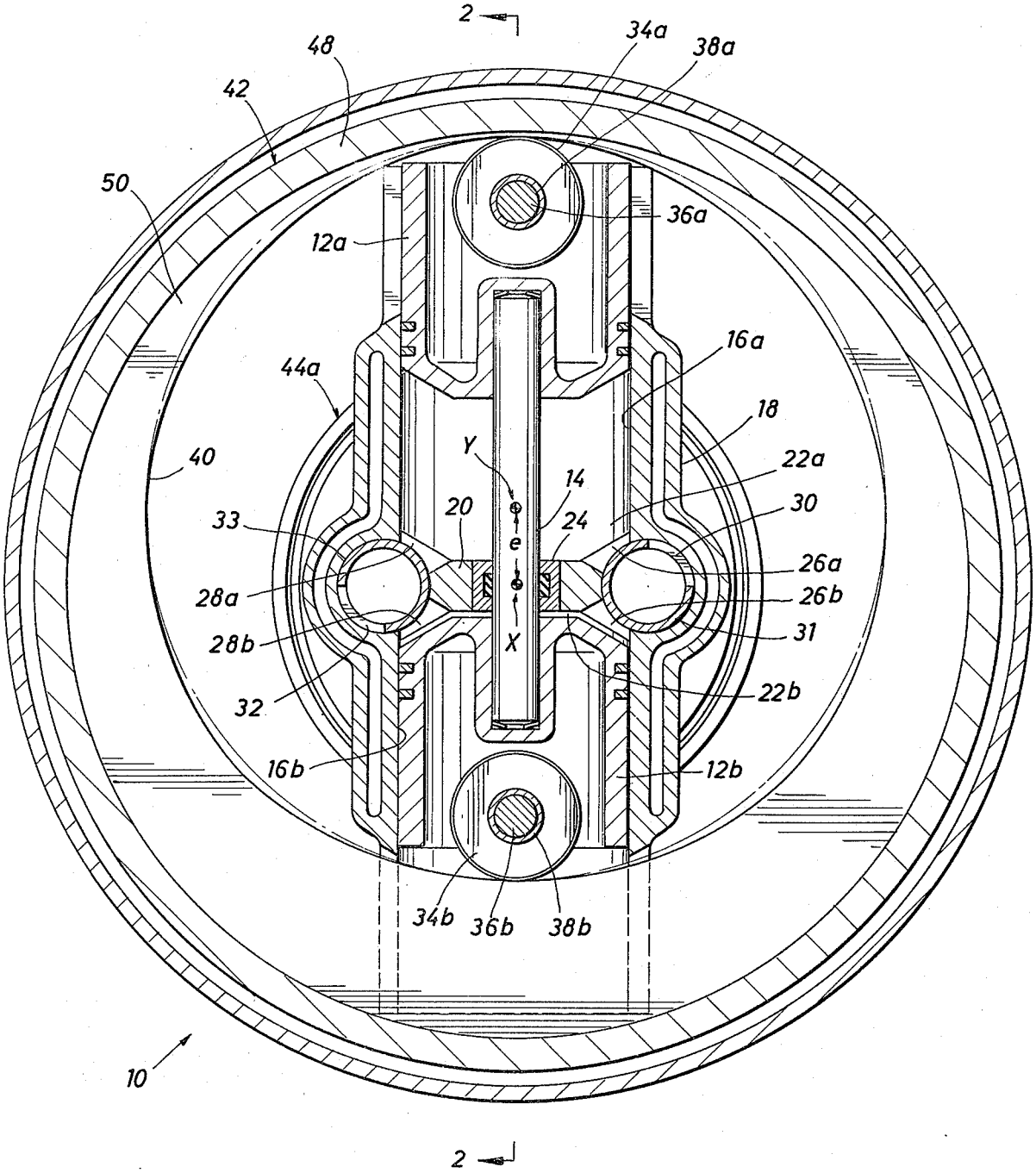
FIG. 1 is a cross sectional plan view of a two cylinder rotary internal combustion engine according to the present invention.
Figure 2:
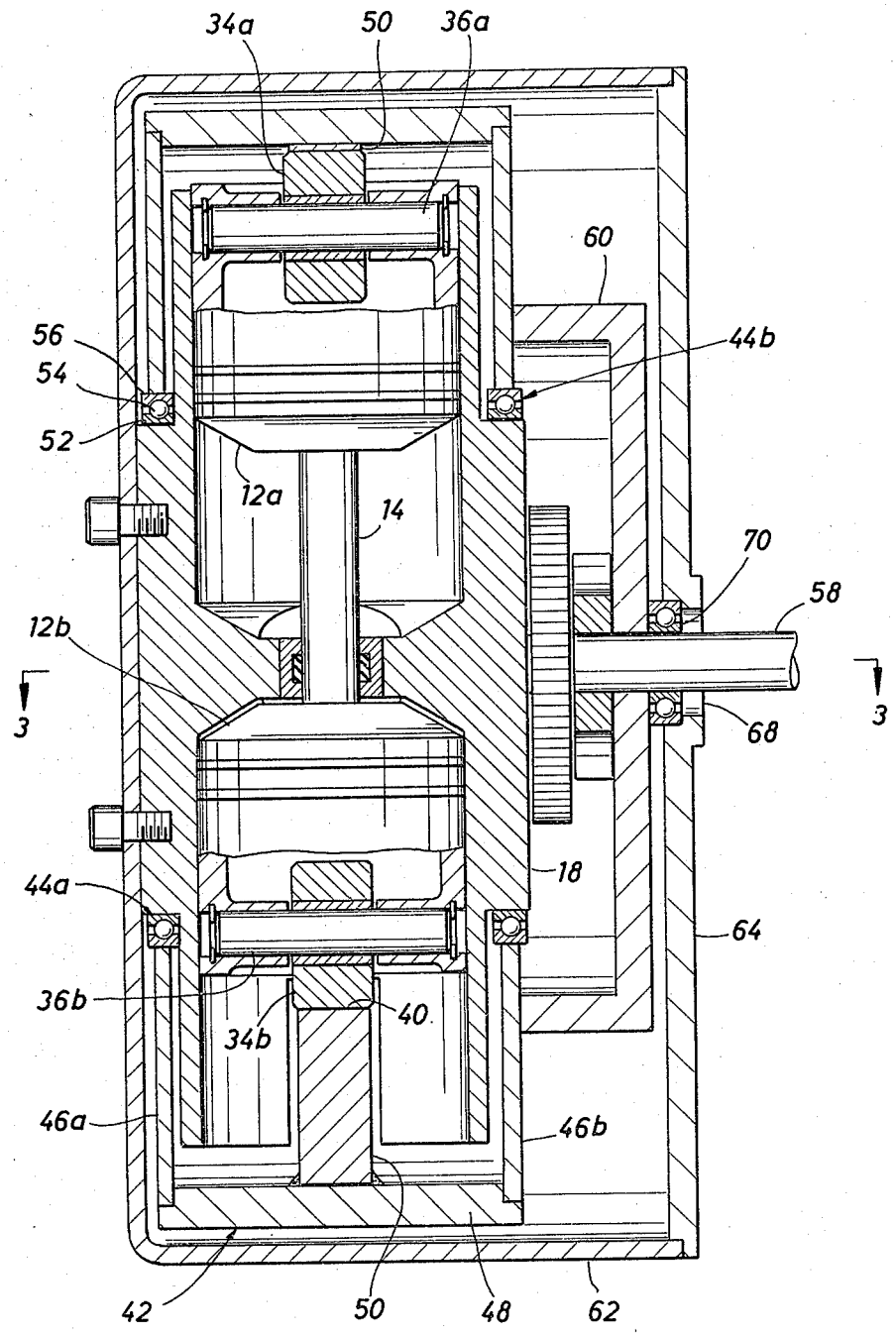
FIG. 2 is a side elevational view of the engine, partially in section, taken generally along the line 2—2 of FIG. 1.

Reference is now made to the drawings for a detailed description of the rotary internal combustion engine according to the present invention. Referring to FIG. 1, the engine shown generally at 10 comprises a pair of horizontally opposed pistons **12*a* and 12*b* interconnected by a common connecting rod 14. Pistons 12*a* and 12*b* are free to reciprocate within colinear cylindrical bores 16*a* and 16*b*, respectively, machined within cylinder block 18. A common dividing wall 20 separates said cylinder bores 16*a* and 16*b* to form combustion chambers 22*a* and 22*b* for pistons 12*a* and 12*b*, respectively. A cylindrical bushing and seal assembly 24 is provided within dividing wall 20 to accommodate passage of connecting rod 14 through said dividing wall. Inlet ports 26*a* and 26*b* are provided for communication of combustible mixture into combustion chambers 22*a* and 22*b*, respectively, at the proper moment in the operational cycle of the engine. As will be described further below, combustible mixture is admitted into a combustion chamber via said inlet ports 26*a* and 26*b* upon alignment of cylindrical valve port 30 with either of said cylinder intake ports. Likewise, combustion chamber exhaust ports 28*a* and 28*b* are provided for combustion chambers 22*a* and 22*b*, respectively. Exhaust gasses are extracted from a combustion chamber 22*a* or 22*b* upon the alignment of cylindrical exhaust valve port 32 with either cylinder exhaust port 28*a* or 28*b*. Cam followers 34*a* and 34*b* are mounted within the lower skirt portion of pistons 12*a* and 12*b* by means of cylindrical pins 36*a* and 36*b*, respectively. Free rotation of cam followers 34*a* and 34*b* is assured by bearings 38*a* and 38*b* provided said cam followers and cylindrical pins 36*a* and 36*b*. Cam followers 34*a* and 34*b* maintain continuous contact with an eccentric cam surface 40 located within an outer rotating ring assembly, shown generally as 42. The outer rotating ring assembly 42 is free to rotate about cylinder block 18. As more clearly depicted in FIG. 2, the outer rotating ring assembly 42 comprises a cylindrical outer ring 48, a pair of annular flanges 46***a* and 46*b* attached to either extremity of the outer ring 48, and an annular cam ring 50 located midway between said annular flanges. Trunion bearings 44*a* and 44*b* are provided on the inner diameter of the annular flanges 46*a* and 46*b* to provide free rotation of the rotating ring assembly 42 with respect to cylinder block 18.

Referring again to FIG. 1, the basic operation of the rotary internal combustion engine of the present invention may be explained by noting first that the center of rotation of the outer rotating ring assembly 42 is a point x detailed therein. It should also be noted that the center of the generally circular eccentric cam surface 40 is a point y located a distance e from point x along the centerline of connecting rod 14. In the position illustrated, piston 12*a* is at its bottom dead center, while piston 12*b* is at its top dead center of travel. For reference purposes, this position may be designated as zero degrees of rotation of the rotating ring assembly 42. As the outer rotating ring assembly rotates about point x, linear displacement is imparted to the piston assembly by means of cam followers 34*a* and 34*b* which maintain contact with the eccentric inner raceway 40. At 180° of rotation of the outer ring assembly 42 from the position shown in FIG. 1, the maximum linear displacement of interconnected pistons 12*a* and 12*b* is attained. At that point piston 12*a* is at its top dead center of travel, while piston 12*b* is at its bottom dead center of travel. It will be understood by one skilled in the art that in this position, the eccentric inner raceway has also rotated 180° resulting in the linear movement of the interconnected pistons a distance equal to twice the distance e. As the outer rotating ring assembly 42 continues rotation beyond 180°, the interconnected pistons reverse direction of travel and approach the position illustrated in FIG. 1 as 360° of rotation, or one complete revolution of the outer rotating ring 42, is completed. The total piston travel in one direction, or piston stroke, is thus equivalent to twice the distance e between points x and y as shown in FIG. 1. The cam profile of the eccentric raceway 40 may be varied to control the characteristic of the linear motion imparted to interconnected pistons 12*a* and 12*b*. For example, surface 40 may represent a constant acceleration cam profile to eliminate non-uniform linear acceleration peaks or alternatively, surface 40 may represent a cam profile which produces a desired amount of piston displacement for a given degree of rotation of the outer rotating ring assembly 42. By comparison, a conventional crank type reciprocating piston engine produces a majority of piston travel over a relatively small portion of rotation of the crank, and this relationship between crank rotation and piston displacement may not be varied.

Referring again to FIG. 2, the outer rotating ring assembly 42 rotates about cylinder block 18, and is held in position with respect thereto by means of upper and lower trunion bearings 44*a* and 44*b* respectively, each of which comprises a circular inner race 52, a circular outer race 56, and a plurality of spherical balls 54 dispersed between said inner and outer races. Power output of the engine is transmitted through output shaft 58 which is connected to the outer rotating ring assembly 42 at the center of rotation of said ring by means of a cylindrical bracket 60. The engine block 18 and rotating ring assembly 42 are completely enclosed by a cylindrical housing 62 and a circular base plate 64. An opening 68 is provided within base plate 64 for extension of output shaft 58 therethrough with a bearing 70 provided between the rotating shaft 58 and the stationary base plate 64. As detailed in FIG. 3, an opening 72 is provided in housing 62 for communication of combustible mixture to a cylindrical inlet valve 31. Likewise, an opening 74 is also provided in housing 62 for extraction of exhaust gasses from cylindrical exhaust valve 33.

Figure 3:
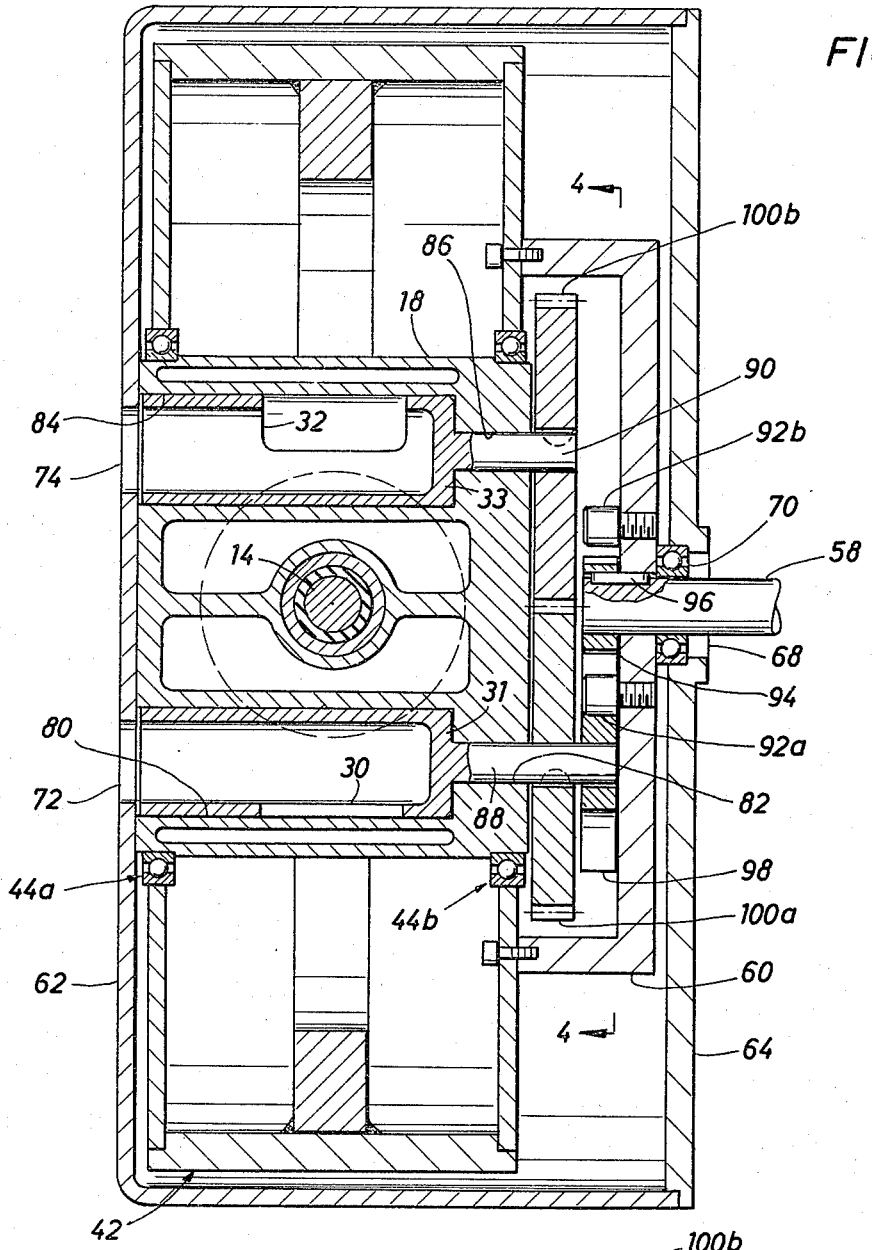
FIG. 3 is a cross sectional side elevation taken generally along line 3—3 of FIG. 2, illustrating a third angle cross sectional view of the apparatus of the present invention.
Figure 4:
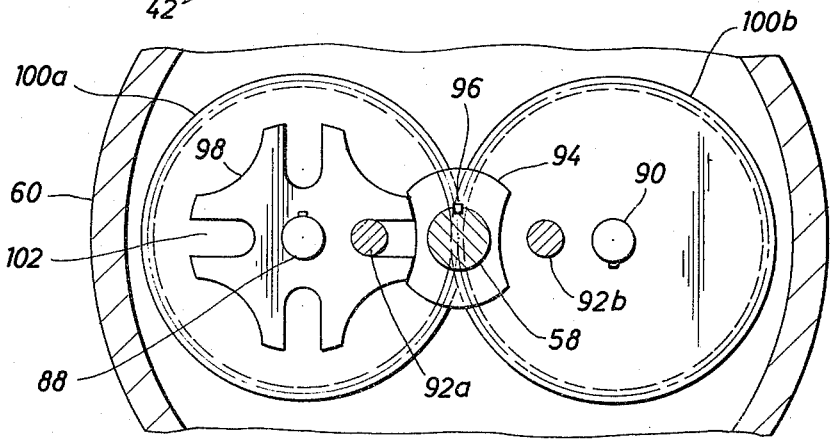
FIG. 4 is a plan view of rotary valve actuation apparatus, partially in section, taken generally along line 4—4 of FIG. 3.

The cylindrical inlet valve 31 is received within a cylindrical bore 80 in cylinder block 18 as shown in FIG. 3. An inlet valve shaft extension 88 extends from the base portion of inlet valve 31 through a reduced bore 82 which is concentric with valve bore 80. Likewise, exhaust valve 33 is received in an exhaust valve bore 84 also provided in cylinder block 18. An exhaust valve shaft extension 90 extends from the base portion of exhaust valve 33 through a reduced bore 86 which is concentric with exhaust valve bore 84. Inlet and exhaust valve shaft extensions, 88 and 90 respectively, extend through respective reduced bores 82 and 86 in cylinder block 18 to engage rotary valve apparatus comprising first and second gears, 100*a* and 100*b* respectively, which mesh together to provide a fixed counter-rotational relationship between said inlet and exhaust valves. In the illustrated embodiment of FIG. 3, timed valve actuation is accomplished by means of a geneva drive mechanism, the driven element 98 of said mechanism being attached to valve shaft extension 88. The geneva driving element, comprising pins 92*a* and 92*b* attached to cylindrical bracket 60, and a positioner element 94 attached to output shaft 58 by means of key 96, rotates in direct relationship to degree of engine rotation. Actuation of the driven element 98 by driving pins 92*a* and 92*b* results in valve actuation which is proportional to degree of rotation of the engine. As more clearly depicted in FIG. 4, the geneva driven element 98 comprises four identical slots as typified by slot 102, equally spaced at 90° intervals about the periphery of said geneva driven element 98. Each of said slots alternately engage pins 92*a* and 92*b* of the geneva driving element attached to the rotating bracket 60 and output drive shaft 58. As is typical for this type of driving arrangement, the uniform rotational movement of the geneva driving element is transformed into a stepwise rotational movement of the geneva driven element 98. In the illustration of FIG. 4, four discrete steps of valve rotation occur during one complete revolution of the driven element 98, and this in turn requires two complete revolutions of the engine output shaft 58 and the geneva driving elements, pins 92*a* and 92*b*. With the geneva driven element 98 attached to inlet valve shaft extension 88, the rotary motion imparted to intake valve 31 is also transmitted to exhaust valve 33 by means of spur gears 100*a* and 100*b* also attached to said valve shaft extensions 88 and 90. The stepwise rotation of intake and exhaust valves 31 and 33 respectively, provides optimum valve positioning for the intake, compression, power and exhaust strokes of a four cycle internal combustion engine. With this arrangement, valve openings may be maintained for a longer period of time with less restriction to flow of gasses, and a lesser degree of valve overlap such as is normally required in internal combustion engines utilizing conventional poppet type valve means.

Figure 6:
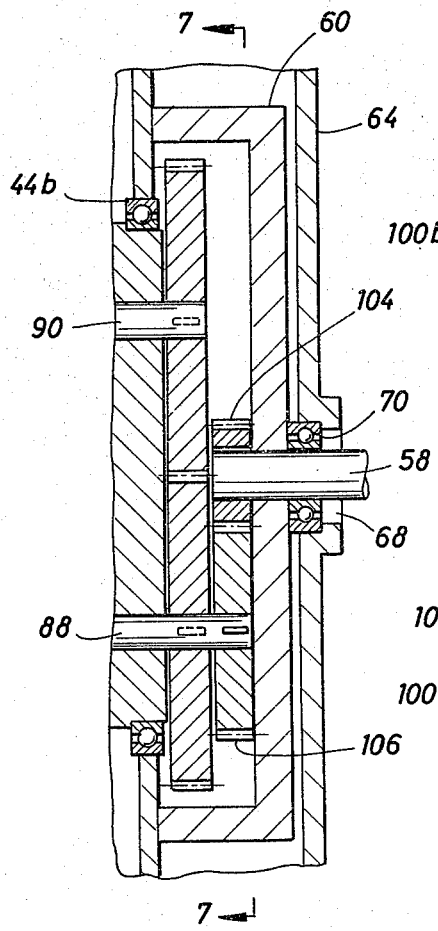
FIG. 6 is a partial side elevational view, in section, of alternative rotary valve actuation apparatus.
Figure 7:
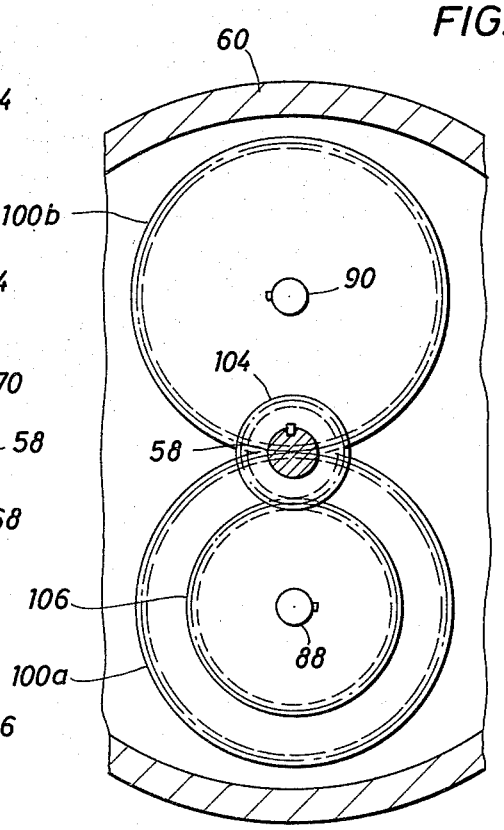
FIG. 7 is a plan view of the apparatus of FIG. 6 taken generally along line 7—7.

Referring to FIGS. 6 and 7, an alternative embodiment of valve actuation apparatus comprises a first gear 104 attached to drive shaft 58 rotating in direct relation to degree of engine rotation, and a second gear 106 which meshes with said first gear. Said second gear 106 is attached to intake valve shaft extension 88, imparting rotary motion thereto. The pitch diameters of said first and second gears are fixed to provide the correct ratio of valve rotation with respect to engine rotation. As previously described, spur gears 100*a* and 100*b*, mounted on intake valve shaft extension 88 and exhaust valve shaft extension 90, respectively, mesh together providing coordinated counter-rotational motion between said intake valve 31 and exhaust valve 33. Thus, rotary motion imparted to intake valve 31 by means of said first gear 104 and said second gear 106 results in corresponding counter-rotational movement of exhaust valve 33.

Figure 5:
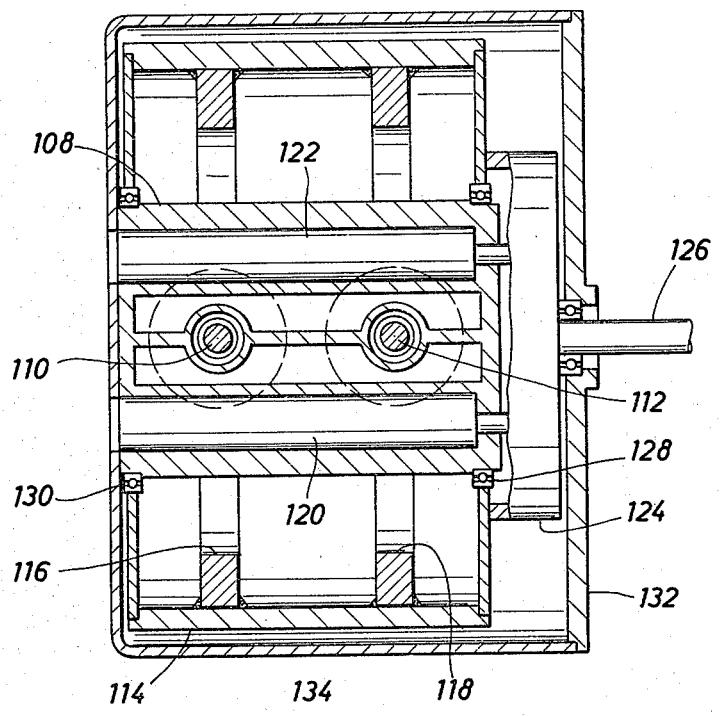
FIG. 5 is a side elevational view, partially in section, of a four cylinder rotary internal combustion engine according to the present invention.

With reference to FIG. 5, a four cylinder, four cycle rotary internal combustion engine according to the present invention is illustrated. The engine comprises a stationary cylinder block 108 having first and second pairs of inwardly facing horizontally opposed pistons interconnected by common connecting rods 110 and 112 respectively. An outer rotating frame assembly 114 includes first and second eccentric cam surfaces 116 and 118, each of which operates in conjunction with one pair of horizontally opposed cylinders. Eccentric cam surfaces 116 and 118 may be positioned in phase with each other such that both pairs of horizontally opposed pistons move in unison. Tubular cylindrical inlet and exhaust valves, 120 and 122 respectively, are provided within cylinder block 108 for admission of combustible mixture and exhaust of products of combustion. Cylindrical valves 120 and 122 are rotably operated by appropriate valve actuation means as previously described, and each includes first and second valve port openings for alignment with matching cylinder intake and exhaust ports at the appropriate moments in the operational cycle of the engine. The outer rotating frame assembly 114 freely rotates about cylinder block 108 by means of upper and lower bearings 130 and 128 respectively. A cylindrical bracket 124 is attached to the rotating frame assembly 114 for transmission of the rotary motion to output shaft 126 attached thereto. A stationary plate 132 and cover 134 completely enclose the engine. It will be understood by those skilled in the art that the above described four cylinder rotary internal combustion engine represents an extension of the basic concept of the present invention illustrated in FIGS. 1–3. Specifically, it is obvious that the apparatus of FIG. 5 comprises the integration of a pair of two cylinder rotary internal combustion engines of the present invention into a single operating unit, retaining only those components necessary, and eliminating all others. For example, the addition of a second pair of horizontally opposed cylinders is accomplished as shown without further modification or complication of the valve actuation apparatus of FIGS. 3 and 4. The result illustrated in FIG. 5 is a compact four cylinder rotary internal combustion engine having a minimum of additional moving parts. Further it can be seen that additional pairs of cylinders could be added without difficulty.

Detailed rotary valve operation in an engine according to the present invention is illustrated in FIG. 8. FIGS. 8A through 8E illustrate rotary valve function in a two cylinder internal combustion engine such as that previously described in connection with FIGS. 1–3. In particular, the valve sequence illustrated is that associated with a four cycle engine, with the respective power, exhaust, intake, and compression cycle being illustrated for pistons 12*a* and 12*b* in FIGS. 8A–8E. In FIG. 8A, piston 12*a* is approaching its top dead center position, completing a compression stroke. Inlet port 26*a* and exhaust port 28*a* are sealed off, or closed, at this point by the cylindrical walls of intake valve 31 and exhaust valve 33 respectively. As piston 12*a* completes its compression stroke, ignition is accomplished by conventional means and the power stroke for piston 12*a* is initiated. At this point, piston 12*b* has completed its power stroke and is initiating its exhaust stroke. Intake valve 31 is now rotated 90° clockwise while exhaust valve 33 is rotated 90° counter-clockwise. These valve positions may be clearly understood with reference to FIG. 8B. It will be noted here that upon rotation of exhaust valve 33 at the commencement of piston 12*b* exhaust stroke, exhaust valve port 32 becomes aligned with cylinder port 28*b* permitting escape of exhaust gasses. With piston 12*b* nearing the completion of its exhaust stroke and piston 12*a* (not shown) completing its power stroke, intake valve 31 is now rotated 90° clockwise, while exhaust valve 33 is rotated 90° counter-clockwise, to the positions illustrated in FIG. 8C. In this position, inlet valve port 30 is aligned with cylinder port 26*b* permitting entrance of combustible mixture for the intake stroke of piston 12*b*. With the rotation of exhaust valve 33, cylinder exhaust port 28*b* has been closed off by the cylinder wall of valve 33 while exhaust valve port 32 is now aligned with cylinder port 28*a* permitting exhaustion of gasses during the exhaust stroke of piston 12*a*. In FIG. 8C piston 12*a* is nearing completion of its exhaust stroke while piston 12*b* (not shown) is nearing completion of its intake stroke. At this point, intake and exhaust valves 31 and 33 again rotate 90° in their respective directions to the positions shown in FIG. 8D. In this position, it is obvious that cylinder exhaust port 28*a* has been closed off while cylinder inlet port 26*a* is now aligned with inlet valve port 30 permitting entrance of combustible mixture during the intake stroke of piston 12*a*. It should also be noted that cylinder ports 26*b* and 28*b* are closed off the by cylindrical walls of inlet valve 31 and exhaust valve 33, respectively, for the compression stroke of piston 12*b*. As piston 12*b* is nearing the completion of its compression stroke as shown in FIG. 8D, inlet valve 31 and exhaust valve 33 again rotate in their respective directions with the result that both cylinder ports 26*a* and 28*a* are closed off in preparation for the compression stroke of piston 12*a*. Cylinder ports 26*b* and 28*b* also remain closed at this point for the power stroke of piston 12*b*. These valve positions are shown more clearly in FIG. 8E. In this position, inlet valve 31 and exhaust valve 33 have completed one full revolution, during which time each of pistons 12*a* and 12*b* have undergone one complete series of operational strokes which are typically associated with a four cycle engine, power, exhaust, intake and compression.

Figure 8A:
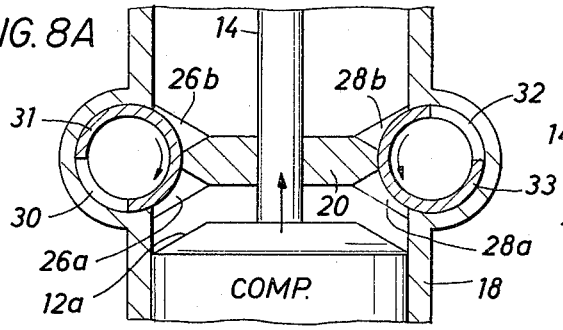
FIGS. 8A through 8J are a series of partial cross sectional plan views of rotary valve apparatus according to the present invention, wherein a four cycle valve sequence of a four cylinder rotary internal combustion engine is illustrated.
Figure 8F:
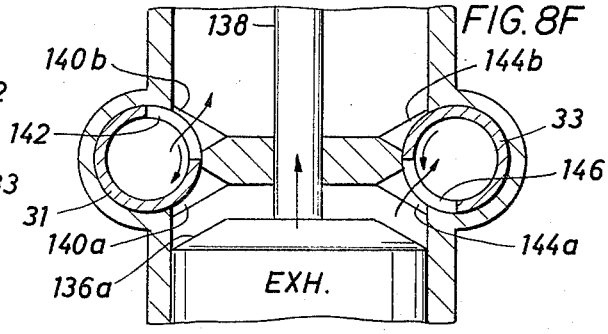
Figure 8B:
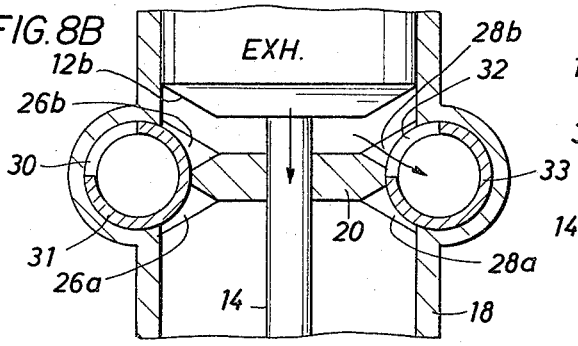
Figure 8G:
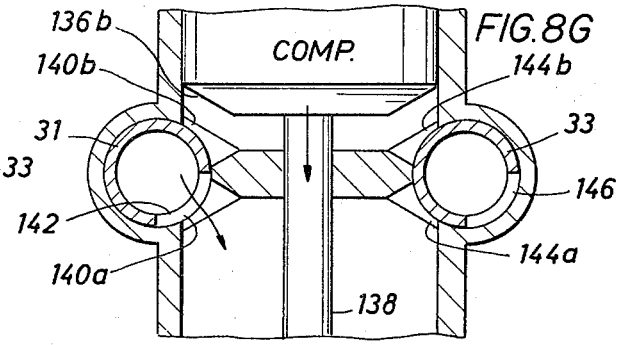
Figure 8C:
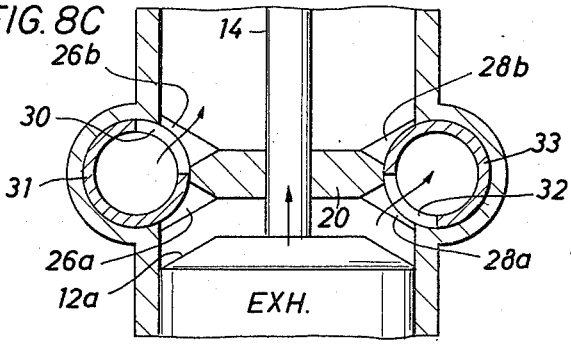
Figure 8H:
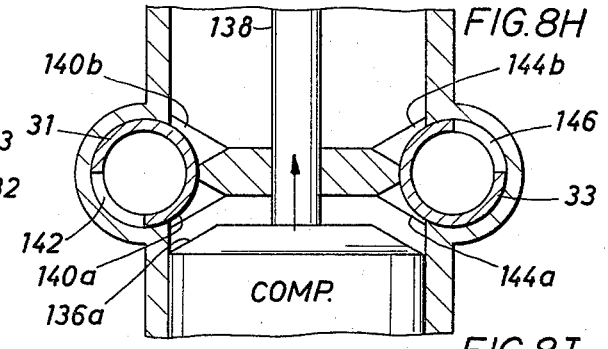
Figure 8D:
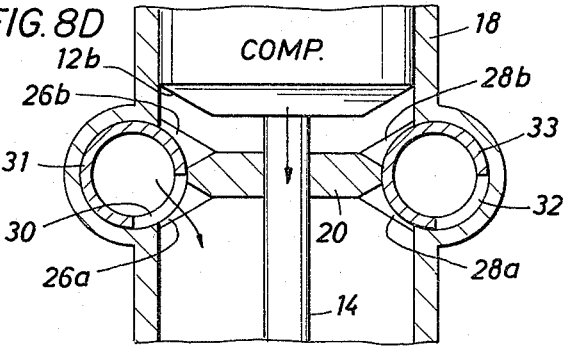
Figure 8I:
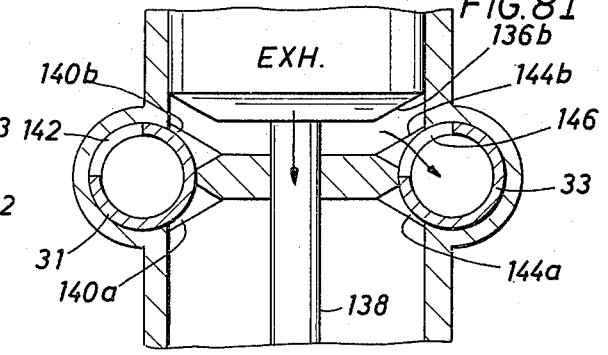
Figure 8E:
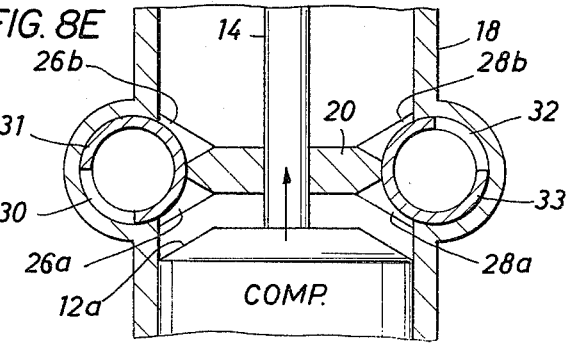
Figure 8J:
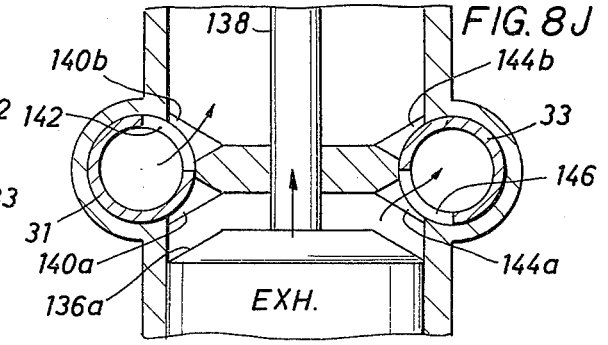

FIGS. 8F–8J represent a similar sequence of valve operation for a second set of horizontally opposed pistons 144*a* and 144*b* which may be located adjacent to pistons 12*a* and 12*b* in an arrangement similar to that illustrated in FIG. 5. In this instance, tubular inlet valve 31 and exhaust valve 33 are extended to incorporate an additional set of valve ports, such as inlet valve port 142 and exhaust valve port 146 as shown in FIG. 8F. An additional set of cylinder intake ports 140*a* and 140*b*, and an additional set of cylinder exhaust ports 144*a* and 144*b* are provided for said second set of horizontally opposed pistons 136*a* and 136*b*. As detailed in FIG. 8F, piston 136*a* is completing its exhaust stroke with exhaust valve port 146 aligned with cylinder exhaust port 144*a*. Likewise, piston 144*b* (not shown) is nearing completion of its intake stroke, with intake valve port 142 aligned with cylinder intake port 140*b*. In a four cylinder rotary internal combustion engine such as that illustrated in FIG. 5, the valve and piston positions of FIG. 8F for the second set of horizontally opposed pistons 136*a* and 136*b* may be related to the valve and piston positions of the first pair of horizontally opposed pistons 12*a* and 12*b* as illustrated in FIG. 8A. For example, while piston 12*a* of FIG. 8A is nearing completion of its compression stroke, piston 136*a* of FIG. 8F is nearing completion of its exhaust stroke. In this manner the firing order of a four cylinder, internal combustion engine as illustrated in FIGS. 8A–8J would follow the order of piston 12*a*, piston 136*b*, piston 136*a*, and finally, piston 12*b*. However, it will be understood by one skilled in the art, that numerous phase relationships between a first pair of horizontally opposed pistons and a second pair of horizontally opposed pistons may be accomodated by adjusting the phased relationship of eccentric cam surfaces 116 and 118 of FIG. 5, and by providing corresponding angular adjustments in the relative positioning of inlet valve ports 30 and 142, and exhaust valve ports 32 and 146 detailed in FIG. 8.

Although not shown, it will be appreciated that spark plug or fuel injection means can be provided.

From the above description, it is apparent that numerous modifications may be made in the apparatus of the present invention without departing from the scope thereof. Accordingly, it is intended that the invention be limited only by the appended claims.

I claim:

1. A rotary internal combustion engine apparatus comprising:

(a) a stationary cylinder block having at least one pair of opposed cylinder bores;

(b) at least one pair of opposed piston means for reciprocating operation within said one pair of opposed cylinder bores;

(c) a piston connecting means comprising a rod connecting at least one pair of opposed piston means together;

(d) a dividing wall between said pair of cylinder bores, having a reduced bore concentric with said cylinder bores for communication of said piston connecting means therethrough;

(e) inlet and exhaust means communicating with each cylinder bore and comprising:

(i) a cylinder inlet port and a cylinder exhaust port communicating with each cylinder bore, generally positioned adjacent to opposite ends of said dividing wall;

(ii) first and second valve bores oriented generally transversely to said cylinder bores and communicating with said cylinder inlet and exhaust ports, respectively, and aligned with said dividing wall;

(iii) first and second valve shaft bores, concentric with said first and second valve bores, passing through said stationary cylinder block;

(iv) a first rotatable valve means contained within said first valve bore for timed admission of combustible fuel mixture;

(v) a second rotatable valve means contained within said second valve bore for timed extraction of exhaust gases;

(vi) rotatable valve actuation means for timed rotation of said first and second rotatable valve means; and (vii) opposing cylinder inlet and exhaust ports intersecting respective ones of said cylindrical valve bores and displaced from one another;

(f) a cam follower means at each extremity of said one pair of opposed piston means;

(g) at least one rotatable eccentric cam means coacting with said cam follower means;

(h) a rotatable frame means secured about said cam means;

(i) an output drive means connected to said rotatable frame means; and (j) a housing means for enclosing said rotatable frame means and stationary cylinder block.

2. The apparatus of claim 1 wherein said one pair of opposed piston means comprise two cylindrical pistons affixed to opposite ends of said piston connecting means, the combustion side of each piston facing inwardly toward the other.

3. The apparatus of claim 1 wherein said piston connecting means comprises an elongated cylindrical rod.

4. The apparatus of claim 1 wherein said rotatable valve actuation means comprise:

(a) a geneva drive mechanism, including a geneva driven element attached to said rotatable frame means and a geneva driven element attached to said solid cylindrical portion of said first rotatable valve means;

(b) a first gear attached to said solid cylindrical portion of said first rotatable valve means; and (c) a second gear attached to said solid cylindrical portion of said second rotatable valve means, and meshing with said first gear.

5. The apparatus of claim 1 wherein said rotatable valve actuation means comprise:

(a) a driver gear attached to said rotatable frame means;

(b) a driven gear attached to said solid cylindrical portion of said first rotatable valve means, and meshing with said driver gear;

(c) a first gear attached to said solid portion of said first rotatable valve means; and (d) a second gear attached to said solid cylindrical portion of said second rotatable valve means, and meshing with said first gear.

6. The apparatus of claim 1 wherein said cam follower means comprise:

(a) a cam roller support structure;

(b) a cam roller; and (c) a cam roller pin for attaching said cam roller to said cam roller support structure.

7. The apparatus of claim 1 wherein said output drive means comprise a cylindrical drive shaft.

8. The apparatus of claim 1 wherein said housing means comprise:

(a) a cylindrical shroud surrounding said rotatable frame means;

(b) an upper portion covering said rotatable frame means and stationary block, with openings for communication with said inlet and exhaust means; and (c) a lower portion covering said rotatable frame means and stationary block, with an opening for extension of said output drive means.

9. The apparatus of claim 1 wherein said rotary internal combustion engine comprises a four cycle engine having two cylinders, with one power stroke occurring for each revolution of said rotatable frame means.

10. The apparatus of claim 1 wherein said rotatable frame means comprise:

(a) a generally annular rotatable cam ring;

(b) an outer cylindrical portion attached to said cam ring;

(c) a first annular flange attached to a first end of said outer cylindrical portion;

(d) a second annular flange attached to a second end of said outer cylindrical portion; and (e) bearing means attached to the inner diameter of said first and second annular flanges for engagement with said stationary cylindrical block to facilitate rotation of said rotatable frame with respect to said stationary cylinder block.

11. The apparatus of claim 10 wherein said bearing means comprise:

(a) a circular outer race on each of said first and second annular flanges;

(b) a circular inner race provided on said stationary cylinder block opposite each said circular outer race; and (c) a plurality of spherical balls dispersed between said inner and outer races.

12. The apparatus of claim 1 wherein said rotatable cam means comprise a generally annular rotatable cam ring with a generally circular inner surface eccentrically positioned with respect to the center of rotation of said cam ring.

13. The apparatus of claim 12 wherein said generally circular inner surface comprises a constant acceleration cam profile.

14. The apparatus of claim 12 wherein said generally circular inner surface comprises a cam profile wherein the distance between contact points of said cam follower means with said surface is a constant, irrespective of degree of rotation of said rotatable cam means.

15. The apparatus of claim 1 wherein each of said first and second rotatable valve means comprise:

(a) a hollow cylindrical portion for insertion within said first and second valve bores;

(b) a first valve port opening in the wall of said hollow cylindrical portion for communication with said cylinder inlet and exhaust ports; and (c) a solid cylindrical portion of lesser diameter for passage through said first and second reduced bores and engagement with said rotatable valve actuation means.

16. The apparatus of claim 15 wherein each of said first and second rotatable valve means further comprise a second valve port opening in the wall of said hollow cylindrical portion for communication with said cylinder inlet and exhaust ports associated with a second pair of opposed cylinder bores.

17. The apparatus of claim 16 wherein said second valve port opening is located 180 degrees opposite to said first valve port opening.

18. The apparatus of claim 1 further comprising:

(a) a second pair of opposed cylinder bores;

(b) a second dividing wall between said second pair of opposed cylinder bores;

(c) a second pair of opposed piston means;

(d) a second piston connecting means;

(e) a second cam follower means at each extremity of said second pair of opposed piston means; and (f) a second rotatable cam means contained within said rotatable frame means.

19. The apparatus of claim 18 wherein said second pair of opposed cylinder bores are parallel to said one pair of opposed cylinder bores, and vertically adjacent thereto.

20. The apparatus of claim 18 wherein said second rotatable cam means is positioned 180 degrees out of phase with respect to said one rotatable cam means.

21. The apparatus of claim 18 wherein said rotary internal combustion engine comprises a four cycle engine having four cylinders, with two power strokes occurring for each revolution of said rotatable frame means.

* * * * *